United States Patent [19]

Lange et al.

[11] 4,118,682

[45] Oct. 3, 1978

[54] DEVICE TO HOUSE A SURGE DIVERTER

[75] Inventors: Gerhard Lange; Günter Schilling, both of Berlin, Germany

[73] Assignee: Siemens Aktiengesellschaft, Berlin & Munich, Germany

[21] Appl. No.: 783,782

[22] Filed: Apr. 1, 1977

[30] Foreign Application Priority Data

Apr. 29, 1976 [DE] Fed. Rep. of Germany ..... 2618991

[51] Int. Cl.[2] ..... H01H 37/04

[52] U.S. Cl. ..... 337/34; 361/119; 361/120

[58] Field of Search ..... 339/133 R, 134, 144 R, 339/276 R; 361/118, 119, 120; 337/34, 186, 207, 208, 213, 214, 246, 28; 338/313

[56] References Cited

U.S. PATENT DOCUMENTS

| | | | |
|---|---|---|---|
| 1,210,568 | 1/1917 | Vogel | 361/120 |
| 1,490,105 | 4/1924 | Greene | 361/120 X |
| 1,890,312 | 12/1932 | Caine | 337/246 X |
| 3,936,785 | 2/1976 | Novak | 361/118 X |
| 3,975,664 | 8/1976 | Baumbach | 361/119 X |

*Primary Examiner*—Harry E. Moose, Jr.

*Attorney, Agent, or Firm*—Hill, Gross, Simpson, Van Santen, Steadman, Chiara & Simpson

[57] ABSTRACT

In a device for housing a surge diverter having electrodes formed as cup-shaped recesses when viewed from the outside of the diverter, provision is made for an angled metal strip which engages the diverter at one end by means of a cylindrical rolled section which form-locks in the recess.

9 Claims, 5 Drawing Figures

DEVICE TO HOUSE A SURGE DIVERTER

BACKGROUND OF THE INVENTION

The invention relates to a device for housing a surge diverter the electrodes of which form cup-shaped recesses on the outside of the diverter.

A device for housing button-shaped surge diverters is disclosed in German patent specification No. 1 299 758, for example. In this device, the button-shaped surge diverters are inserted in pairs in a housing comprising two similar insulator sections held together with a clamping ring such that the diverter electrodes are directly accessible from the outside of the housing. The housing is insertable in a fitting which is made of two similar insulator sections carrying contact holders and is preferably held together with rivets. In this device, one strip-shaped contact is held elastically against each of the outward facing poles of the button-shaped surge diverters.

In known fittings for surge diverters, the diverters are eitherheld in contact by springs or are inserted in relatively costly screwcontact fittings. These devices have the particular disadvantage that replacement of the surge diverters in the event of damage, such as could be caused by sputtering, for example, becomes very difficult and is thus relatively expensive.

The use of compact and powerful surge diverters also requires the use of additional fittings or connectors that are more than adequate for the power of the surge diverters. Indeed, the fittings or connectors should not be damaged under loads which will cause short-circuiting or even the destruction of the surge diverter.

SUMMARY OF THE INVENTION

Consequently, an object of this invention is to provide a surge diverter fitting for heavy-current loads. To achieve this object, it is proposed in accordance with the invention that in each case an angled metal strip provided with a cylindrical rolled section at one end engages at that end in a recess of the diverter in a form-locking manner. Here the cylindrical rolled section is preferably corrugated longitudinally so that contact is produced along a plurality of lines.

In one embodiment of the invention the other angled end of the metal strip has the form of a cable lug.

In an extension of the invention with a surge diverter having a circular middle electrode, i.e. a so-called two-stage diverter, a narrow metal strip is provided which encloses a portion of the middle electrode (about two-thirds) and the angled outer end of which again has the form of a cable lug. Preferably the middle electrode is a flange encircling the middle electrode periphery which preferably engages the grooved metal strip in the enclosed zone.

In another embodiment of the invention the metal strips which are provided with a cylindrical rolled section at one end and engage at that end in the recesses in the electrodes of the surge diverter in form-locking manner, are so formed at the other end that they constitute the electrical connectors of an adapter in which the surge diverter is disposed.

A surge diverter fitting in accordance with the invention has the advantage that by virtue of the threaded or plug-in connectors, the surge diverters can be introduced without further means of assistance into a casing with connecting leads, for example by means of a simple screw-connection or by pressing or pushing them in.

These connections allow trouble-free diversion of the alternating and surge currents involved. Such a fitting can be produced very economically, in particular. One special advantage derives from modifying the cylindrical form of the rolled metal connectors so that contact is produced along four lines, for example. In this device the high contact pressure at the lines of contact in the cup-shaped electrode recesses produces a good electrical connection with a low contact resistance, essential for a high surge-current capacity. The connectors can be preferably pressed into nickel-plated electrodes of the surge diverter at a later time. It is particularly advantageous that the connectors need not necessarily be soldered to the electrodes.

Preferably the middle connectors for two-stage diverters surround two thirds of the circumference of the diverter and can also be fitted after the electrodes have been nickel-plated. The slightly grooved recess expediently provided in the metal strip ensures a good fit and prevents lateral displacement. Depending on the material of the middle electrode, soft-soldering is preferably used in the case of copper and spot-welding in the case of materials that weld well (e.g. vacon).

The connectors are preferably made of nickel-plated sheetiron, brass, bronze, nickel, silver or copper.

The invention will be explained in detail below with further features with reference to the figures in the drawing. In the figures, corresponding parts have the same reference numbers.

DESCRIPTION OF THE PREFERRED EMBODIMENTS

Figure 1:
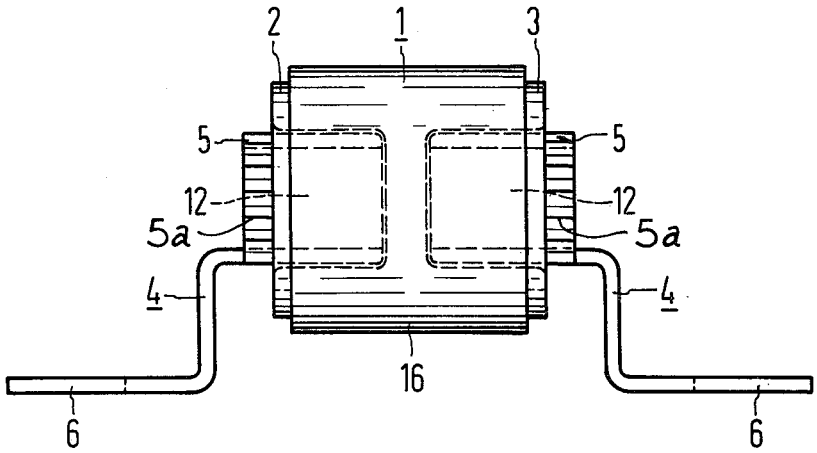
FIG. 1 shows a side view of a fitting in accordance with the invention for a single-stage diverter.

FIG. 1 shows a strip-metal fitting 4 for a single-stage surge diverter 1. The surge diverter 1 includes a tubular insulator 16 made of glass or ceramic material. The electrodes 2, 3 which exhibit a cup-shaped recess 12 on their outsides in each case, are hermetically fitted in the ends of the tubular insulator 16. One end of angled metal strip 4 provided with a cylindrical rolled section 5 engages in each of the cup-shaped recesses 12. The cylindrical rolled sections 5 preferably have longitudinal corrugations **5*a* as shown in FIG. 1 for improved contact with the recesses 12**.

The two metal strips 4 are stepped so that both screw connections can be made in one plane. The end of the metal strip 4, which is preferably about 0.5 mm thick, has the form of a cable lug 6 with which a simple screw connection for electrically high loads is made.

Figure 3:
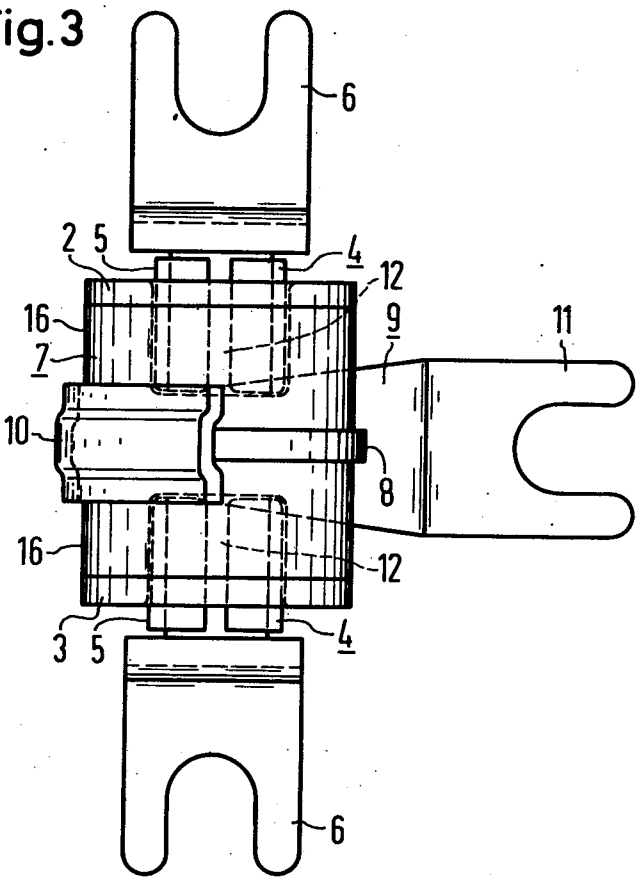
FIG. 3 is a top view of the fitting in the direction of arrow III in FIG. 2.
Figure 2:
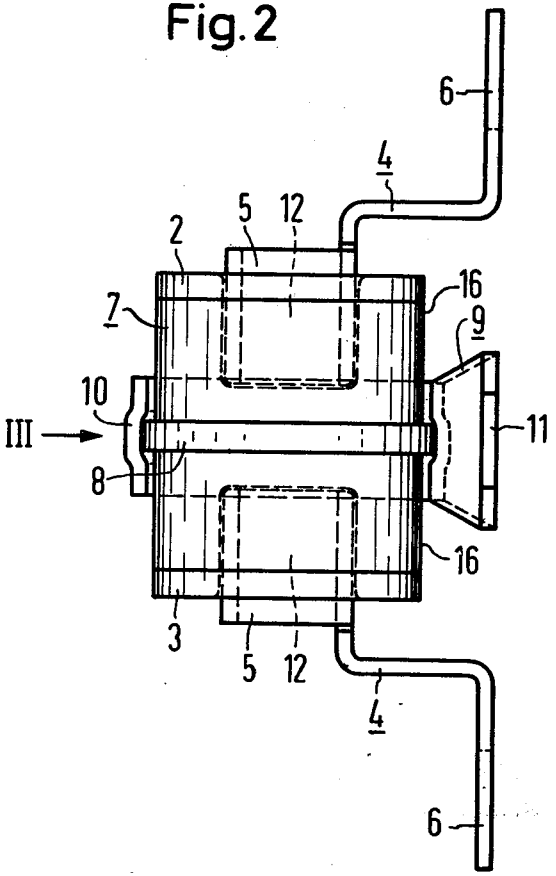
FIG. 2 shows a side view of a fitting in accordance with the invention for a two-stage diverter.

The surge diverter 7 shown in FIGS. 2 and 3 again comprises a tubular insulator 16 in the ends of which the electrodes 2, 3 provided with cup-shaped recesses 12 are hermetically fitted. With this surge diverter 7 an additional electrode is provided in the form of a circular middle electrode 8 which forms two discharge stages with the two end electrodes 2, 3. Such surge diverters are consequently known as two-stage diverters, as well. Again, a stepped metal strip 4 with a cylindrical rolled section 5 engages in a form-locking manner in the recess 12 in each of the electrodes 2, 3. The other end has the form of a cable lug 6. The middle electrode 8 has a portion which projects beyond the tubular insulator 16 and with which the metal strip 9 having a groove 10 preferably encloses about two thirds of the electrode 8 and engages therewith in a form-locking manner. The metal strip 9 is also formed as a cable lug 11 for screw connection at its other end angled outwardly. Again the thickness of the metal strip 9 forming the middle connector for the surge diverter 7 is preferably about 0.5 mm. All three screw-connections can be made in one plane so that simple casing connections are possible.

Figure 5:
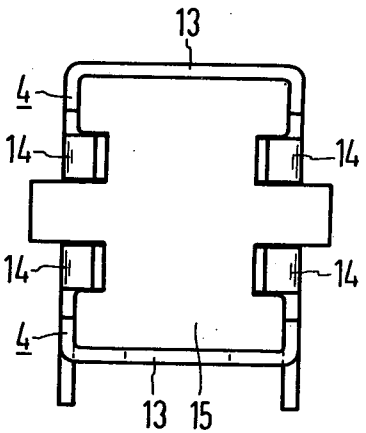
FIG. 5 is a top view of the fitting in the direction of arrow V in FIG. 4.
Figure 4:
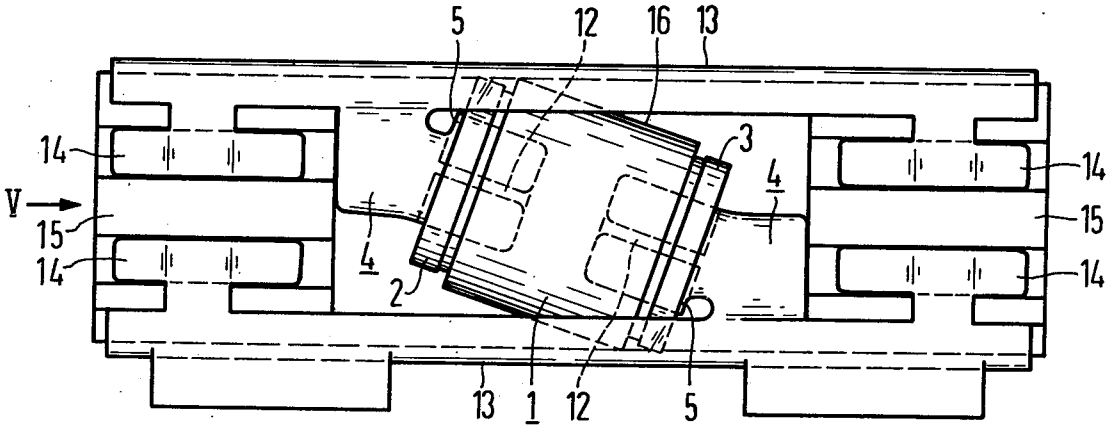
FIG. 4 is a side view of another embodiment of a fitting in accordance with the invention for single-stage diverters.

The device shown in FIGS. 4 and 5 for housing a surge diverter 1 again has two angled metal strips 4 which engage at ends provided with cylindrical rolled sections 5 in a form-locking manner in the cup-shaped recesses 12 in the outsides of the electrodes 2, 3 of the surge diverter 1. The electrodes 2, 3 of the surge diverter 1 are inserted into the ends of a tubular insulator 16 and form a hermetic casing with the latter, this casing being filled with gas, preferably an inert gas. In this embodiment, the metal strips 4 have the form of contact rails 13 at their free angled ends. The two contact rails 13 are the external connectors for the device made in the form of an adapter, the two end faces of which receive insulators 15 made of ceramic material or plastic, for instance, which are shaped roughly like a double T when viewed end-on in the direction of arrow V (FIG. 5) and insulate the two contact rails 13 from one another electrically. At their ends the contact rails 13 have projections 14 which are angled to both sides and T-shaped when viewed from the side, the T cross-members of these interlocking with the insulators 15 when the device is assembled. The surge diverter 1 is disposed at an angle roughly in the center of the device. For this angle, as shown in the side view in FIG. 4, one metal strip 4 is bent towards the front at an angle from the angled rolled section 5, the other metal strip 4 is bent towards the rear at an angle from the angled rolled section 5, and both metal strips 4 then pass, after being bent once again, into the sections forming the contact rails 13.

Although various minor modifications may be suggested by those skilled in the art, it is understood that we wish to embody within the scope of the patent warranted hereon, all such embodiments as reasonably and properly come within the scope of our contribution of the art.

We claim as our invention:

1. A device for housing a surge voltage diverter having electrodes which form cup-shaped recesses on the outside of the diverter, comprising angled metal strips each having at one end a cylindrical rolled section means for engaging one of the cup-shaped recesses in a form-locking manner.

2. A device as in claim 1, characterized in that the other end of the angled metal strips forms a cable lug.

3. A device for housing a surge voltage diverter as in claim 1, said device having a narrow metal strip means for surrounding at least two thirds of a middle electrode of a surge voltage diverter, and said narrow metal strip means having a cable lug formed at an angled outer end.

4. A device as in claim 3, characterized in that the narrow metal strip means has a groove means for engaging with a projection of a middle electrode of a surge voltage diverted.

5. A device as in claim 1, characterized in that the cylindrical rolled section means is corrugated longitudinally so that contact is produced along a plurality of lines in the cup-shaped recesses.

6. A device as in claim 1, characterized in that the other end of the angled metal strips each have a contact rail connected thereto having projections which engage an insulator.

7. A device for connecting to a surge voltage diverter having hermetically sealing electrodes which form cup-shaped recesses on the outside at each end of a diverter body portion, comprising an angled metal strip for each end of the diverter, each angled metal strip having first and second bends opposite to one another, one end of the metal strip having a spring-like cylindrical portion means for intimate engagement within one of the cup-shaped recesses, the other end of the metal strip having a spade-like cable lug.

8. The device of claim 7 wherein said device has a narrow metal strip means with a groove for engaging a middle electrode of a surge voltage diverter, said narrow metal strip means having a spade-like cable lug.

9. The device of claim 7 in which the spade-like cable lugs are aligned in the same plane.

* * * * *